United States Patent [19]

Roth

[11] 4,103,830

[45] Aug. 1, 1978

[54] FLAT SPRAY NOZZLE HEAD FOR A MANUALLY-OPERATED SPRAY GUN

[75] Inventor: Heinrich Roth, Kreuzlingen, Switzerland

[73] Assignee: Theo Krebs AG, Kreuzlingen, Switzerland

[21] Appl. No.: 753,489

[22] Filed: Dec. 22, 1976

[30] Foreign Application Priority Data

Jan. 28, 1976 [CH] Switzerland ..... 1029/76

[51] Int. Cl.[2] ..... B05B 1/04

[52] U.S. Cl. ..... 239/587; 239/599

[58] Field of Search ..... 239/526, 597, 599, 587, 239/600

[56] References Cited

U.S. PATENT DOCUMENTS

| | | | |
|---|---|---|---|
| 1,338,242 | 4/1920 | Moise | 239/587 X |
| 2,052,362 | 8/1936 | Roselund | 239/587 X |
| 2,647,796 | 8/1953 | Ziherl | 239/587 X |
| 3,421,702 | 1/1969 | O'Brien | 239/587 X |
| 3,831,862 | 8/1974 | Calder | 239/526 |

*Primary Examiner*—John J. Love

[57] ABSTRACT

A flat spray nozzle head for a manually-operated spray gun for spraying a material, such as a color material or the like without compressed air, comprising a nozzle portion containing a nozzle body arranged therein and a connection portion for connection with a spray pump for spraying the material to be applied. An infeed element for the infeed of the sprayed material to the nozzle body is arranged within the nozzle portion. This infeed element is rotatably mounted in the connection portion. The nozzle portion is thereby rotatably connected with the connection portion.

7 Claims, 2 Drawing Figures

FLAT SPRAY NOZZLE HEAD FOR A MANUALLY-OPERATED SPRAY GUN

BACKGROUND OF THE INVENTION

The present invention relates to a new and improved construction of a flat spray nozzle head for a manually-operated spray gun for spraying without need of compressed air, comprising a nozzle or mouth portion and a nozzle body arranged therein, there further being provided a connection portion for connection with a pump for spraying the material, the nozzle portion being rotatably connected with the connection portion.

Flat spray nozzle heads for manually-operated spray guns, which are not only used for industrial purposes but also for hobby or home use, should be economical to acquire and therefore simple in construction.

SUMMARY OF THE INVENTION

Hence, it is a general object of the present invention to provide an improved construction of a flat spray nozzle head for manually-operated spray guns which satisfies the above requirements.

Another object of this invention aims at the provision of a new and improved construction of flat spray nozzle head which is extremely simple in construction and design, reliable in operation, economical to manufacture, and dependable in use.

Now in order to implement these and still further objects of the invention, which will become more readily apparent as the description proceeds, the flat spray nozzle head of this development is manifested by the features that in the nozzle portion there is arranged an infeed element for the infeed of the sprayed material to the nozzle body, this infeed element is rotatably mounted in the connection portion.

According to a further embodiment of the invention the infeed element can be constructed as a bipartite member having an outer portion or casing within which there is arranged the other part of such bipartite infeed element. The outer portion has a forward end which directly engages with the front of the nozzle body and the rearward end which engages with the connection portion. With this arrangement there is provided additional security against undesired detachment of the nozzle portion from the infeed element in the event of excessive pressure build-up, for instance due to nozzle clogging.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
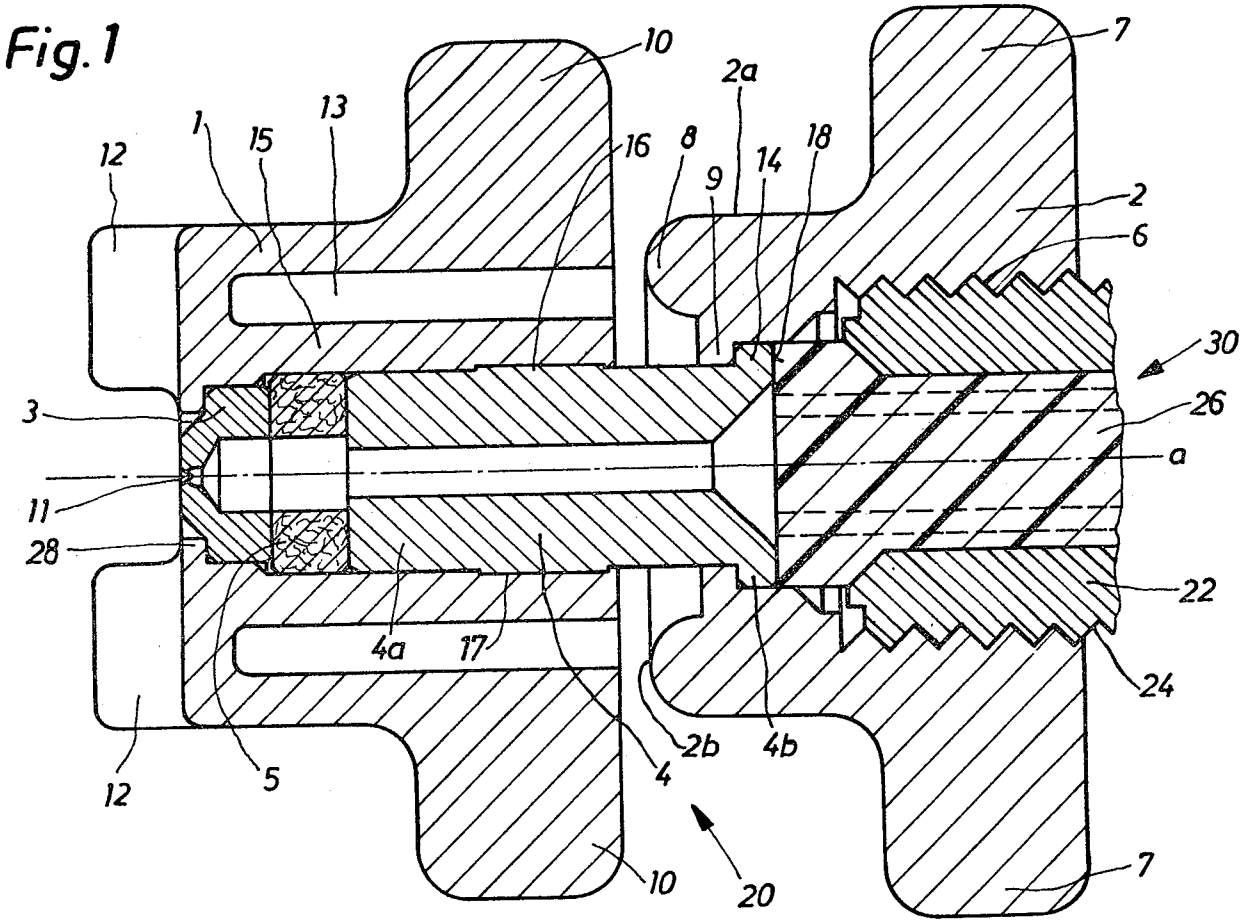
FIG. 1 is a sectional view through a first embodiment of a flat spray nozzle head constructed according to the present invention.

Describing now the drawings, and considering initially the exemplary embodiment of flat spray nozzle head 20 as shown in FIG. 1, it will be understood that the same comprises a nozzle or mouth portion 1, a connection portion 2 for connection with a not particularly illustrated spray gun, only part of which has been indicated by reference character 30, for spraying any desired material, a nozzle body 3 inserted into the nozzle portion 1, an infeed element 4 and a conventional seal 5. Any suitable construction of spray gun can be employed, typically for instance as taught in Swiss patent No. 580,987, granted Sept. 15, 1976, the disclosure of which is incorporated herein by reference. It is to be understood that details of the spray gun are not crucial to the understanding of the principles of the invention which deal with the construction of the flat spray nozzle head 20 for use therewith.

Continuing, the connection portion 2 will be seen to comprise internal threading 6 by means of which the connection portion 2 i.e. the nozzle head 20 can be threadably connected to a pipe connection or stud 22 having external threading 24 and which is part of the spray gun 30. A plurality of vanes or wings 7 protrude from the jacket or outer surface **2*a* of the connection portion 2, these vanes serving as manual engagement members to facilitate threading of the connection portion 2 at the spray gun. At the end surface 2*b* of the connection portion 2 confronting the nozzle or mouth portion 1, there is formed a circular ring-shaped bead or collar 8. At this bead 8 there merges an inner flange or rim 9 of the connection portion 2**.

The nozzle portion 1 also will be seen to possess protruding vanes or wings 10 or equivalent structure. These vanes 10 facilitate changing the position of the fan-like flat jet of the material to be sprayed emanating from the nozzle 11 of the nozzle body 3. At both sides of the nozzle 11 there are arranged ribs 12. These ribs 12 constitute safety elements. By virtue of the fact that between the nozzle 11 and a sprayed surface there is present a spacing corresponding to the height of the ribs 12, there is reduced the danger of the injury when unintentionally spraying an operator. In the nozzle portion 1 there is formed a circular ring-shaped groove 13. The nozzle body 3 is advantageously press fitted into the nozzle or mouth portion 1.

In the embodiment under discussion the infeed element 4 is constructed as a relatively thick-walled tubular element or sleeve **4*a*. Protruding from one end 4*b* of the sleeve 4*a* i.e. its rearward end with respect to the material flow, is a ring flange 14. The sleeve 4*a* is pressed into the nozzle portion 1. During pressing-in of the sleeve 4*a* into the nozzle portion 1 its cylindrical section 15 formed by the groove 13 elastically gives. The intermediate region of the outer surface of the sleeve 4*a* will be seen to comprise a peripheral bead or protuberance 16 which is fitted into a flat recess 17 at the inner surface of the nozzle portion 1, so that there is exactly determined the axial position of the sleeve 4*a* in the nozzle portion 1. Between the sleeve 4*a* and the nozzle body 3 there is arranged the substantially ring-shaped seal 5. This prevents the color i.e. the material being sprayed from axially escaping at the region between the sleeve 4*a* and the nozzle body 3**.

The annular or ring-shaped flange 14 of the sleeve **4*a* bears at the inner flange 9 of the connection portion 2. During threading of the connection portion 2 upon the pipe connection 22 of the spray gun 30 such pipe connection comes to bear, via the spray gun-outlet feed member 26 at the flank or rear face 18 of the ring-shaped flange 14, and thus exerts pressure upon such ring-shaped flange 14**.

Consequently, a frictional force acts to prevent rotation of the nozzle portion and thus to prevent any undesired change in the position of the flat jet. By more or less tightly tightening the connection portion 2 upon the pipe connection 22 it is possible to alter the force needed for rotating the nozzle portion 1.

With the connection portion 2 tightened it is therefore possible to exactly adjust and maintain the position of the flat spray jet by actuating the vanes or wings 10 of the nozzle portion 1.

The nozzle head 20 is extremely simple in construction and will be seen to here possess only four main components, wherein the nozzle portion 1 and the connection portion 2 are formed of plastic, the nozzle body 3 and the infeed element 4 are formed of metal, such as for instance brass. The infeed element 4 serves, on the one hand, as a feed channel means for the infeed of the sprayed material to the nozzle body 3 and, on the other hand, as a connection means between the nozzle portion 1 and the connection portion 2 in order to interconnect both such components in the correct relationship to one another. The infeed element 4, which advantageously is a tubular element, is engaged by the nozzle portion 1 so as to be axially non-displaceable and held radically fixed therein. Thus, the connection portion 2 is connected by means of a plug connection with the nozzle portion 1, and the tubular infeed element 4 is locked with the nozzle portion 1 in that the peripheral bead 16 engages with the flat recess 17. The nozzle or mouth portion 1 is formed of a resilient material and exerts a pressure upon the tubular element or sleeve 4*a* forming the infeed element 4, so that there is provided a good press fit.

Figure 2:
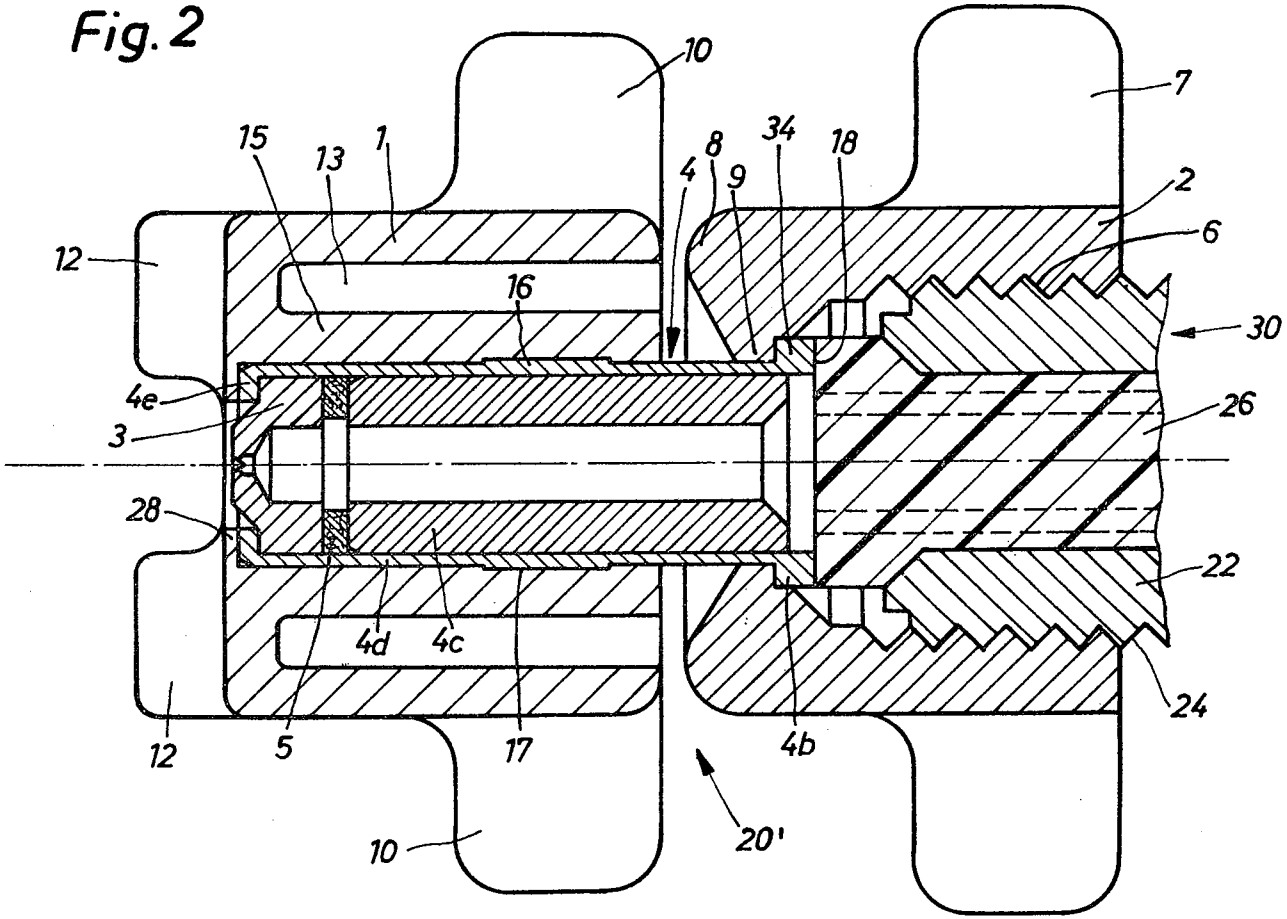
FIG. 2 is a sectional view through a second embodiment of flat spray nozzle head designed according to the present invention.

In FIG. 2 there is illustrated a modified construction of nozzle head 20' which basically affords all of the advantages realized with the arrangement of FIG. 1. Due to the similarity between these two embodiments there have been generally employed the same reference characters for the same or analagous components. Furthermore the disclosure of FIG. 2 will confine itself basically with those differences prevailing with respect to the embodiment of FIG. 1. It has been found with the embodiment of FIG. 1, when the nozzle body 3 clogged, it was possible for considerable forces to build-up, causing an axial load to be applied directly against the retaining shoulder 28 of the nozzle portion 1 which, in turn, might possibly undesirably axially load and deform such nozzle portion somewhat and cause it to unintentionally become detached from the infeed element 4 and be propelled away. To safeguard against or minimize the likelihood of this happening, the variant construction of FIG. 2 contemplates utilizing a bipartite construction of infeed element 4 consisting of the parts or portions 4*c* and 4*d*. In particular, there will be recognized that there is provided an outer portion or casing 4*d* which encloses a substantially tubular inner part or sleeve 4*c* of such infeed element 4 as well as the seal 5 and the nozzle element 3 located forwardly thereof. Just as was the case for the embodiment of FIG. 1, here also the bipartite infeed element 4 may be formed of metal, such as for instance brass. The forward end wall 4*e* of the outer casing 4*d* of the infeed element 4, in the arrangement under discussion, will be seen to engage over the front portion of the nozzle element 3 and snugly bears thereat. Hence, in the event of clogging of the nozzle element 3 the existing forces are transmitted to the end wall 4*e* of the outer casing 4*d*, in turn exerting a force which is transmitted to the connection portion 2 by means of the rear flange or shoulder 34 of such outer casing 4*b*. Consequently, the forces do not act directly upon the nozzle portion 1, so that the same is more likely to retain its clamping engagement with the outer casing 4*b* and will not undesirably detach therefrom. In all other respects the construction and operation of the embodiment of FIG. 2 is essentially like that of FIG. 1.

While there are shown and described present preferred embodiments of the invention, it is to be distinctly understood that the invention is not limited thereto, but may be otherwise variously embodied and practiced within the scope of the following claims. ACCORDINGLY,

What is claimed is:

1. A flat jet spray head for a manually-operated spray gun operating without compressed air for spraying a material, comprising:

a connection portion adapted to be connected to a spray gun;

a nozzle portion;

a nozzle body arranged in said nozzle portion;

an infeed element arranged in the nozzle portion for the infeed of material to be sprayed to said nozzle body;

said infeed element being of bipartite construction composed of an inner portion and an outer casing portion surrounding said inner portion; said outer casing portion connecting the nozzle portion to the connection portion and having a front end wall engaging with said nozzle body and a rear end wall rotatably mounted in said connection portion, whereby any forces exerted on the nozzle body are transmitted to and taken up by said connection portion.

2. The spray head as defined in claim 1, wherein:

said connection portion comprising a hollow body having an inner flange;

said rear end wall of the outer casing portion engaging behind the inner flange of the hollow body.

3. The spray head as defined in claim 1, further including a seal arranged between said nozzle body and said inner portion.

4. The spray head as defined in claim 1, further including:

a seal arranged between the nozzle body and the infeed element;

said nozzle portion and said connection portion each having protruding vanes serving as handgrip means.

5. The spray head as defined in claim 1, said nozzle portion being rotatable about an axis of rotation and provided with groove means extending substantially concentrically with respect to the axis of rotation of the nozzle portion;

said groove means being open in a direction towards said connection portion;

a resilient flexible hollow plug formed of one piece with the nozzle portion into which engages the infeed element.

6. The spray nozzle as defined in claim 1, comprising means for adjusting the position of a flat spray jet with respect to a spray gun, including:

means providing a surface arranged at the flat spray nozzle head such that it forms a frictional seat with a surface of the spray gun, in order to produce a force opposing rotation of the nozzle body determining the position of the flat spray jet.

7. A flat jet spray head for a manually-operated spray gun operating without compressed air for spraying a material, comprising:

a connection portion adapted to be connected to a spray gun;

a nozzle portion;

a nozzle body arranged in said nozzle portion;

means for rotatably connecting the nozzle portion with the connection portion;

said rotatably connecting means including an infeed element arranged in the nozzle portion for the infeed of material to be sprayed to said nozzle body; and said infeed element being rotatably mounted in said connection portion, said nozzle portion being rotatable about an axis of rotation and provided with groove means extending substantially concentrically with respect to the axis of rotation of the nozzle portion;

said groove means being open in a direction towards said connection portion;

a resilient flexible hollow plug formed of one piece with the nozzle portion into which engages the infeed element.

* * * * *